United States Patent [19]

Zintz et al.

[11] 4,185,652

[45] Jan. 29, 1980

[54] SUBAQUEOUS SEQUENCE VALVE MECHANISM

[75] Inventors: Howard Zintz; Richard C. Fisher, both of Walnut Creek; John F. Gee, Oakland, all of Calif.

[73] Assignee: NL Industries, Inc., Hightstown, N.J.

[21] Appl. No.: 846,723

[22] Filed: Oct. 31, 1977

[51] Int. Cl.[2] ..... E21B 43/01

[52] U.S. Cl. ..... 137/81; 60/398; 137/628; 137/637; 251/25

[58] Field of Search ..... 137/81, 236; 60/398; 251/1 R, 1 A, 1 B, 31, 47; 166/368

[56] References Cited

U.S. PATENT DOCUMENTS 3,993,100 11/1976 Pollard et al. ..... 137/637 X

*Primary Examiner*—Allan Cohan
*Assistant Examiner*—Richard Gerard
*Attorney, Agent, or Firm*—Lothrup & West

[57] ABSTRACT

A subaqueous sequence valve mechanism includes one or more main valves each adapted to be disposed in the water below the surface thereof. A first expansible chamber hydraulic actuator on the main valve operates that valve and also operates a second expansible chamber device against a spring. A hydraulic pressure line or lead from a controlled source above the surface is joined to and controls the submerged actuator. The second expansible chamber is connected in sequence through a throttle valve and a pressure relief valve to one side of a movable barrier in a hydraulic accumulator. On the other side of the movable barrier the accumulator is open to the water. There is also a return, one way flow valve shunting the pressure relief valve. The accumulator is hydraulically protected by a spring loaded check valve discharging into the water.

5 Claims, 5 Drawing Figures

SEE FIG-3

SUBAQUEOUS SEQUENCE VALVE MECHANISM

BRIEF SUMMARY OF THE INVENTION

In modern underwater drilling equipment, among other environments, there is often a need to provide subaqueous valves with attendant hydraulic circuits for the purpose of operating submerged equipment. Sometimes the operation is of large valves for controlling powerful functions. There is some difficulty in that valves below the surface of the water are subject to the subaqueous pressure. It is an advantage to be able to assemble such a valve and initially to operate it above the surface and then to be able to position it, sometimes at a great depth, below the surface and still have it operate in a satisfactory fashion, as observed at the surface. It is also advantageous to reduce the number of hydraulic lines that must be extended between the water surface or just above the water surface and an installation sometimes at a great depth below. It is again a desideratum that such hydraulic equipment not only be reliable in the customary sense but that it also not leak any oil or at least any substantial quantity of oily fluid into the water surroundings.

This is accomplished in the present instance by sending a hydraulic operating lead from a suitable source of hydraulic pressure above the surface of the water down to a substantial depth to a first expansible chamber operator at one end of a main valve to be controlled. The main valve is joined to a responsive, second expansible chamber mechanism which moves in accordance with the operation of the first expansible chamber operator and against the urgency of a spring. The second expansible chamber is connected through a throttle valve and through a variable relief valve to one end of a hydraulic accumulator in which there is a movable barrier. The other side of the barrier is open to the water at substantially the elevation of the main valve and so is subject to the same subaqueous pressure. A one way flow valve shunts the relief valve, and a spring loaded check valve can open into the water in the event of an emergency high pressure condition in the hydraulic accumulator. With this arrangement it is not normally necessary to discharge any substantial quantity of used hydraulic pressure fluid into the water, and there is compensation for the increase in pressure in the controlling hydraulic liquid due to the depth of the main valve below the surface.

DETAILED DESCRIPTION

Figure 1:
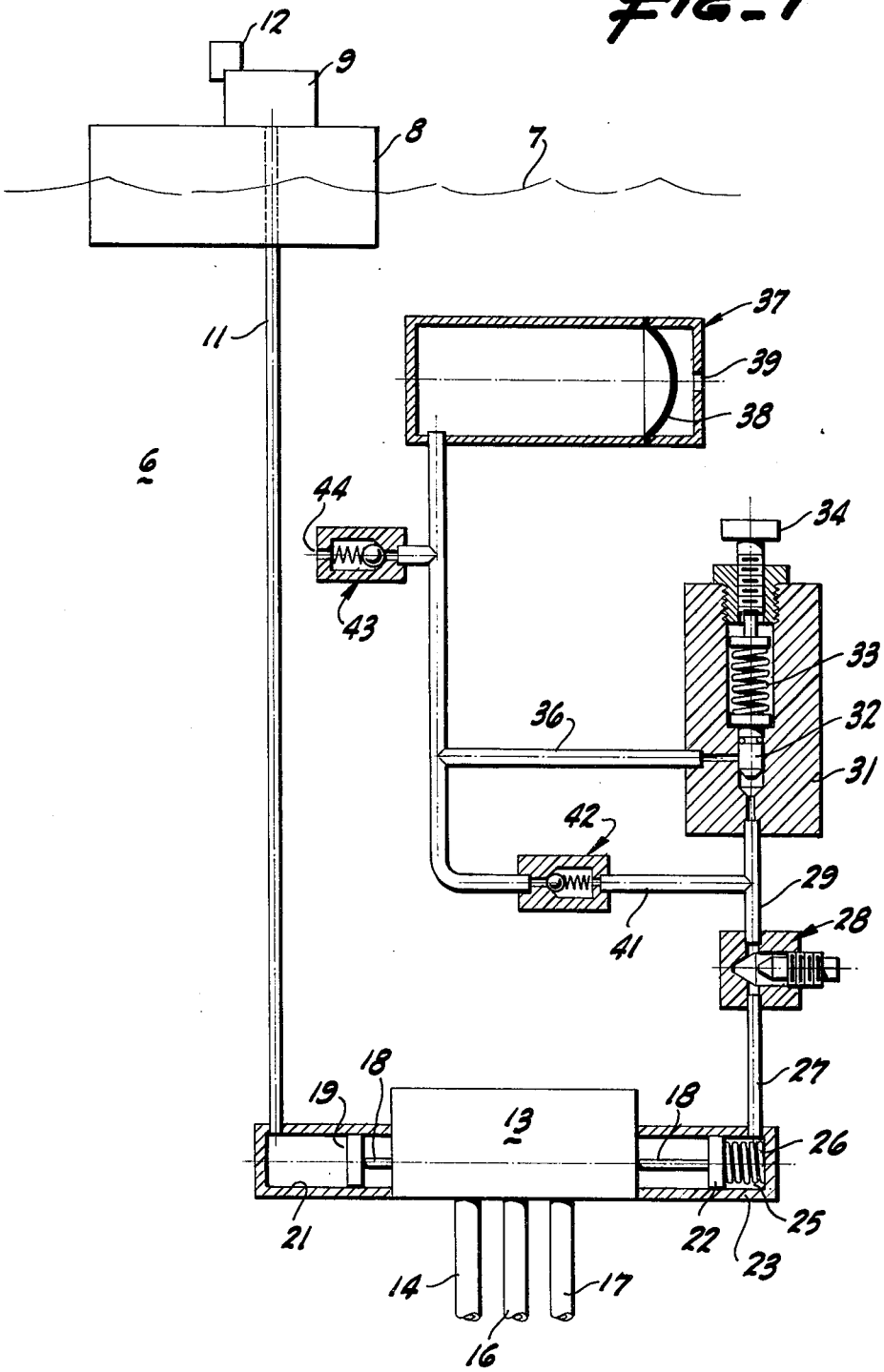
FIG. 1 is a diagram showing a single subaqueous sequence valve mechanism constructed pursuant to the invention, certain portions being shown in cross-section and other portions being entirely diagrammatic.

In a typical or representative installation, as shown in FIG. 1, the site is a body of water 6; for example, the ocean, having a surface 7 on which or adjacent which there is disposed a barge 8 or drilling platform or the like containing among other things a source 9 of hydraulic controlling fluid under some pressure. There is a rigid or flexible line 11 extending from the source 9 of pressure to an installation below the surface 7. The source 9 of pressure also includes a controller 12 subject to adjustment by an attendant to vary the pressure from the source 9 that appears in the line 11.

At some substantial depth below the surface 7, there is located a main valve 13. This is a standard hydraulic valve adapted to be connected to its own source of pressure through a line 14, to be connected to a vent through a line 16 or to be connected to a pressure discharge line 17, depending entirely upon the location within the main valve 13 of a standard valve spool, not shown, changing its position in accordance with the position of a spool rod 18.

In order that the spool rod 18 can be shifted, it is provided with a piston 19 reciprocable within a first expansible chamber 21 connected to one end of the line 11. The piston 19 is thus subject to variable pressure from the controller 12 at the surface and is also subject to the added pressure or head due to the liquid column in the line 11.

The spool rod 18 extends also from the other side of the spool of the main valve 13 and carries a responsive device in the form of a piston 22 reciprocable within a cylinder 23, the enclosed volume being considered as a second expansible chamber 25. There is a spring 26 in the second expansible chamber providing a force on the piston 19 opposing pressure in the first expansible chamber. When there is a relatively low pressure in the first expansible chamber 21, the spring 26 translates the spool rod 18 completely to the left. When there is sufficient or a relatively high pressure within the first expansible chamber 21, the second expansible chamber 25 is contracted and the spring 26 is compressed. Thus, by varying the pressure within the first expansible chamber 21, the spool rod 18 and the main valve spool can be actuated.

The position of the piston 22 and the momentary volume of the second expansible chamber 25 are not entirely dependent upon the relative force of the spring 26 but also depend upon a hydraulic circuit.

Pursuant to the invention, the second expansible chamber 25 is connected by a line 27 through an adjustable throttle valve 28 to a line 29 connected into the upstream end of a relief valve 31. Within such relief valve there is a plunger 32 backed by a spring 33 and an adjustment mechanism 34 having the effect of varying the spring force and so the resistance to opening pressure on the plunger 32. When the plunger is opened, flow is through a line 36 to one end of a hydraulic accumulator 37. This preferably is in the form of a flexible diaphragm but can as well be a piston. The position of the movable barrier 38 varies in accordance with the quantity of hydraulic fluid within one end of the hydraulic accumulator 37.

Particularly pursuant to the invention, the hydraulic accumulator 37 is placed at substantially the same elevation as the main valve 13 and on the side of the movable barrier 38 opposite the inlet of the line 36 has an opening 39 to the surrounding water.

In addition, there is a shunt line 41 extending from the line 29 on the upstream side of the relief valve 31 to the line 36 on the downstream side thereof, being joined in parallel with the relief valve between the line 29 and the line 36. In the shunt line 41 is a one way flow valve 42. This one way flow valve checks flow tending to go around the relief valve 31 toward the hydraulic accumulator 37. However, reverse flow from the hydraulic accumulator 37 to the inlet or upstream side of the relief valve 31 is permitted since the one way flow valve 42 opens against an interior spring to afford flow in the back direction.

Also, the line 36 has a spring loaded check valve 43 having an opening 44 to the surrounding water. The spring loaded check valve 43 is completely closed under all normal operating conditions so that the hydraulic system is entirely closed and there is no discharge or release of hydraulic system fluid into the surrounding water. Should there be an accident and should the internal pressure get inordinately high, then the spring loaded check valve 43 opens to the sea but only for enough time to permit the excessive pressure to drop and without releasing any more hydraulic fluid than necessary to bring the pressure back to the operating value.

A main valve 13 of this sort in this environment and with the stated adjuncts is used and referred to as a sequence valve since the main valve 13 will remain closed under the pressure of the spring 26 and of hydraulic fluid in the hydraulic accumulator 37 unless and until the pressure in the line 11 under the control of the controller 12 is made to exceed the initial pressure. There can be arranged under the water a number of hydraulic circuits as shown in FIG. 1, each including a main valve such as 13, all connected in parallel and each set to remain closed under its own particular, initial pressure, but to open above such pressure. With that kind of an arrangement, when the operator adjusts the controller 12 to increase the hydraulic pressure in the line 11, nothing may at first be accomplished with respect to the several submerged main valves. The line pressure may then be raised to slightly more than the minimum operating pressure of the lowest pressure main valve. What that occurs, the lowest pressure sequence valve opens. If the pressure in the line 11 is then dropped, that lowest pressure main valve then closes. However, should the pressure in the line 11 be increased after the first main valve opens, then the first main valve remains open while a second main valve set for a higher pressure then opens. This series or sequence can be continued for any selected number of main valves.

For the operation of each circuit as shown in FIG. 1 and including a main valve 13, a particular operating point or pressure can be established at the surface and before subaqueous installation by moving the adjustment mechanism 34 or control to set the pressure for opening of the relief valve 31. The relief valve 31 does not open until there has been a correspondingly high pressure generated in the second expansible chamber 25. Thus, the particular sequencing or opening pressure of an individual, main valve 13 can be adjusted or set. Since the hydraulic accumulator 37 is open to the sea on one side, this setting can be arranged at a chosen value on the surface. When the entire device is submerged, the pressure added by the extended hydraulic column within the line 11 is exactly balanced by the water pressure at the same depth communicated through the opening 39.

Figure 2:
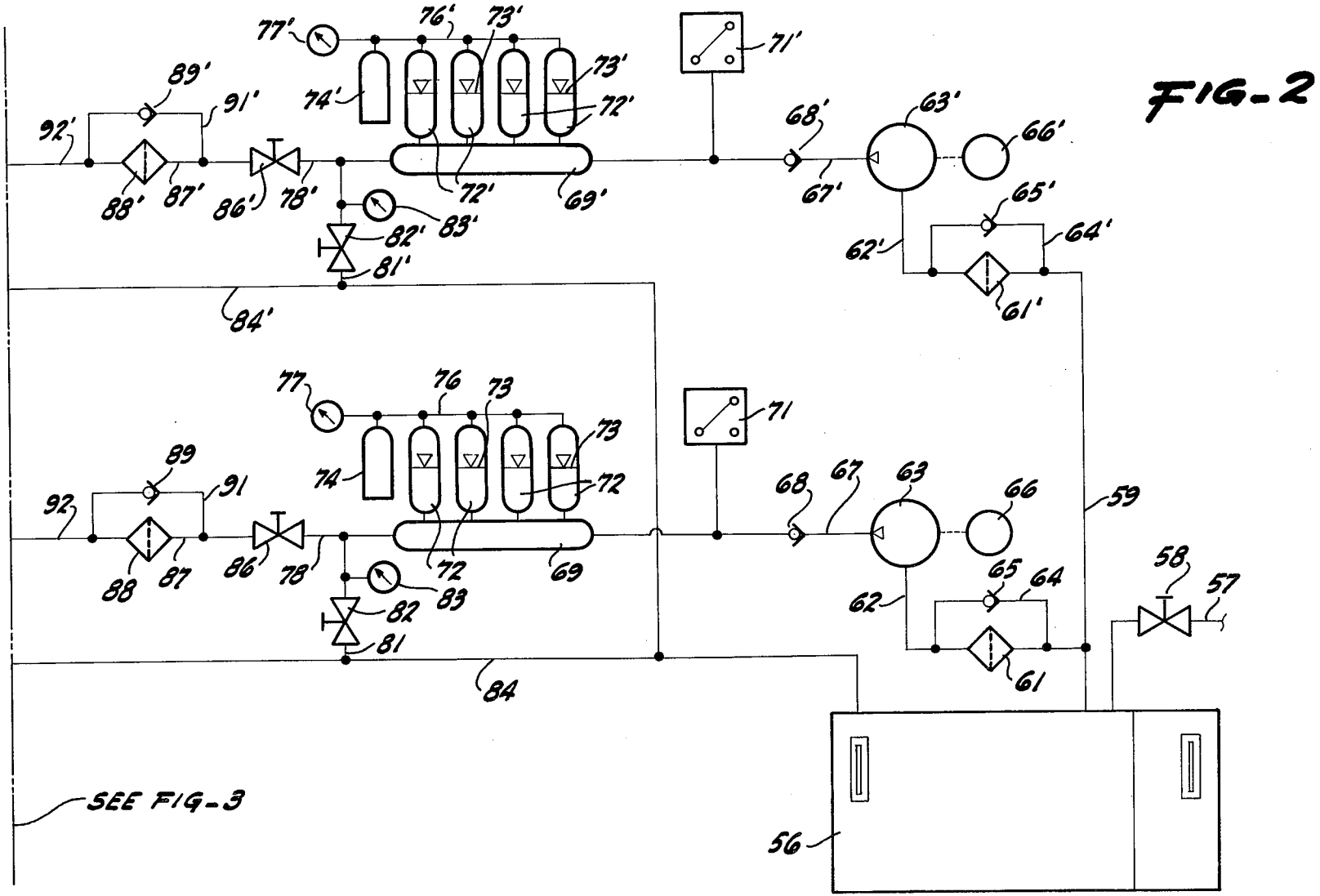
FIGS. 2, 3, 4 and 5 are portions of a diagram of one part of a typical large subaqueous, sequence valve mechanism, the drawing sheets being related as shown by the legends thereon.
Figure 3:
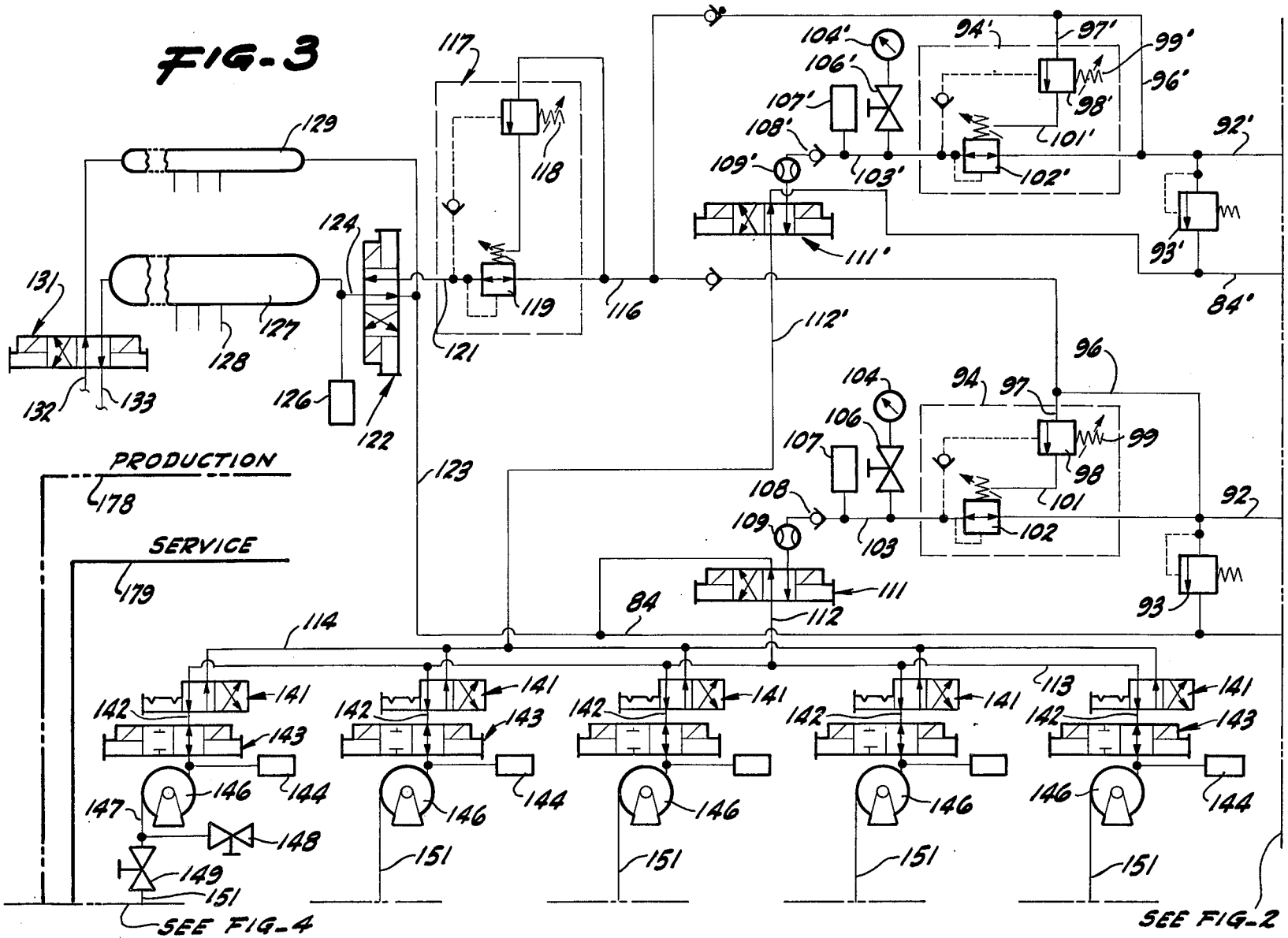
Figure 4:
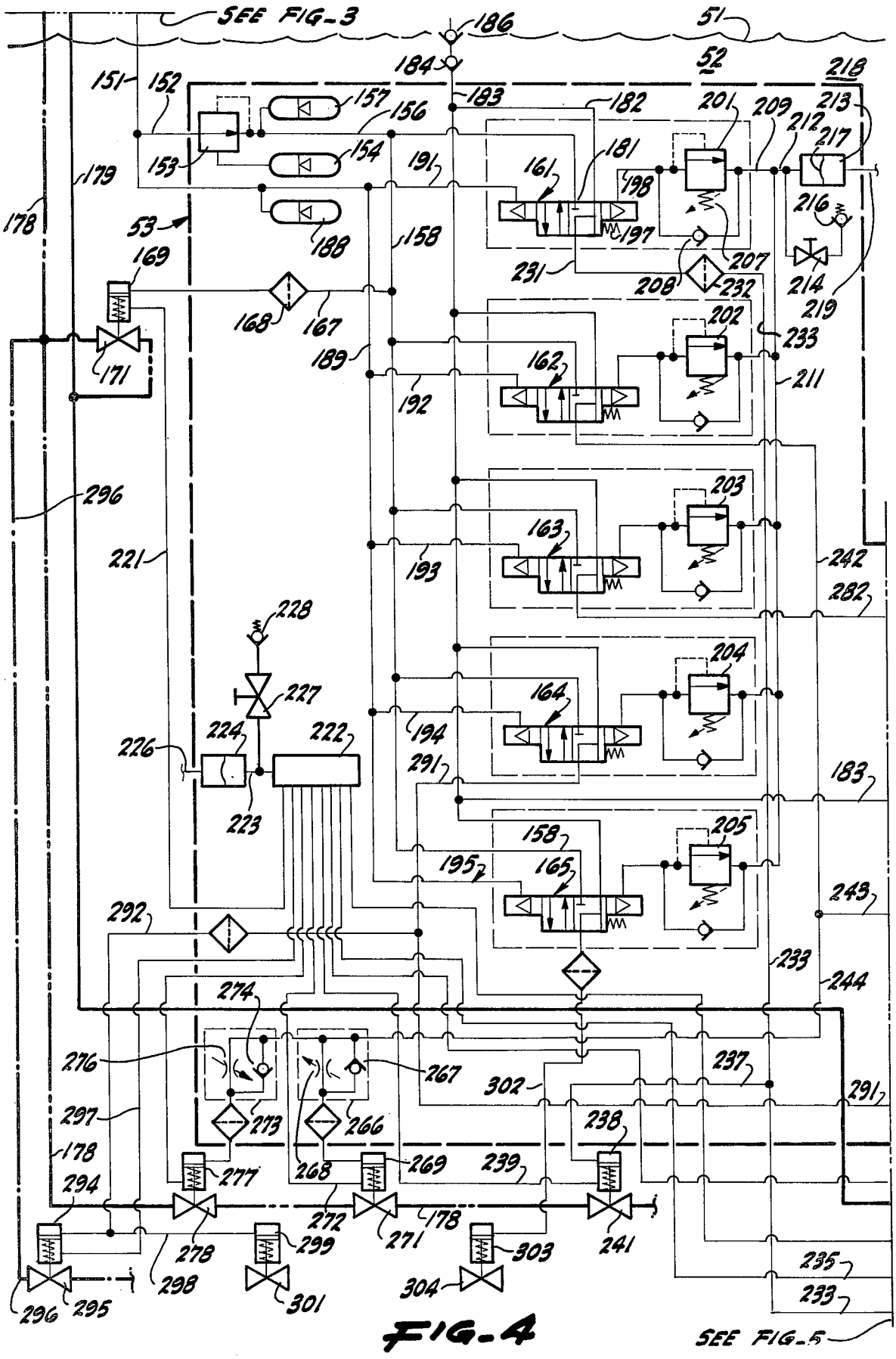

As an example of a sequence or series of main valves installed in the same general environment below the water level 51 (FIG. 4) of a body 52 of water, there is provided an arrangement, one portion being shown in FIGS. 2 and 3, in a practical form for utilization in connection with a bottom operation including a number of different enclosures 53, one of which is disclosed in detail in FIG. 4, and the others of which are not shown in detail but are substantial duplications of the enclosure 53.

At a convenient location above water, there is provided a reservoir 56 (FIG. 2) of hydraulic working fluid. While under many circumstances such fluid has a petroleum base, in the present instance and for ecological reasons due to possible leakage, the fluid employed is actually fresh water which may carry a small amount of a bio-degradable lubricating material with it. The reservoir 56 is supplied with fresh water from a source 57 connected through a valve 58.

To utilize the liquid from the reservoir, there are provided two substantially identical above-surface systems. The redundancy is justified, since it is essential that each system from time to time be serviced; and that operation must continue even though one system is out of commission temporarily.

Representative of both systems (the second of which carries the same reference numerals with primes) is a system in which liquid from the reservoir 56 is withdrawn through a conduit 59 and then through a filter 61 to the inlet pipe 62 of a pump 63. In the event the filter 61 should at any time become severely clogged, there is a bypass path 64 around the filter incorporating a check valve 65 closed against back flow.

The pump 63 is driven by any appropriate kind of motor 66 and discharges through a line 67 controlled by a check valve 68 leading to a pressure chamber 69. Pressure within the line 67 activates a pressure switch 71 set to stop operation of the motor 66 at a set high pressure; for example, 5000 psi. The pressure chamber 69 is connected to a battery of accumulators 72, the lower portions of which carry the liquid and the central portions of which are bridged by flexible diaphragms or pistons 73. The upper portions are charged with an inert gas under pressure from a tank 74 acting through a manifold 76. Preferably the gas is nitrogen, and its pressure is indicated by a gauge 77.

Outflow from the pressure chamber 69 is through a line 78 having a bypass 81 controlled by a valve 82. A pressure gauge 83 shows pressure in the bypass. The bypass 81 goes to a return line 84 joined to the reservoir 56 for returning liquid thereto. A control valve 86 governs flow from the line 78 into a line 87 carrying another filter 88 shunted by a check valve 89 in a connecting line 91. A pipe 92 leading from the filter 88 is subject to a relief valve 93 (FIG. 3) extending to the return line 84 and preferably set at an overload pressure higher than the pressure at which the switch 71 responds. For example, if the switch is set at 5000 psi, the relief valve 93 is set at 5200 psi so that should the pressure switch 71 fail and the pump 63 continue to operate and to build up pressure, then the excess is bled off from the pipe 92 into the return line 84.

The pipe 92 continues into a pressure reducing valve acting as a variable pressure controller 94 or servomechanism. The pipe 92 has a branch 96 with a lead 97 going to a component 98 responsive to a manual pressure set point controlling mechanism 99 for setting the downstream pressure at any selected or desired value. By manually operating the manual pressure set point controlling mechanism 99, a supervisor can set at any precise value or can cover any desired range of hydraulic pressure transmitted from the lead 97 through the manual pressure set point controlling mechanism 99 and through a connector 101 into a slave regulator 102 interposed in the pipe 92. The output from the slave regulator 102 follows exactly the manual pressure set point controlling mechanism 99 and supplies the selected pressure in an output line 103. This line is conveniently provided with a pressure gauge 104 accessible through a valve 106 and is also provided with a pressure transducer 107 for remote indication of the line pressure. The output line 103 likewise contains a check valve 108 and goes through a flow meter 109 to afford an indication of the amount of hydraulic fluid flowing therethrough.

The hydraulic fluid then travels at the selected pressure through a shiftable valve 111 conveniently provided with a remote control, not shown. In the position illustrated, the shiftable valve 111 blocks the output line 103 and interconnects the return line 84 through a line 112 to a manifold 113 for all of the various enclosures 53. When the shiftable valve 111 is shifted, the output line 103 connects through the line 112 directly to the manifold 113. Thus, the entire system terminating in the output line 103 can be blocked from or can be connected to and for operation of the manifold 113. Similarly, the output line 103' controlled by a shiftable valve 111', as shown, is blocked; but when the shiftable valve 111' is shifted, the output line 103' is connected through a connector 112' to a manifold 114 separate from and parallel to the manifold 113 and designed to connect in parallel to all of the enclosures 53.

Because the redundant installation is made in an environment which might require auxiliary equipment of undetermined nature, the branches 96 and 96' are joined in a common line 116 extending to a variable pressure controller 117, like the variable pressure controller 94, having a manual control knob 118 thereon. The variable pressure controller 117 acts through a slave unit 119 to afford an output pressure in a line 121 of any desired selected value or of any varying range of values. The line 121 supplies a remotely controlled valve 122 also joined to a vent line 123 connected to the return line 84 and so leading back to the reservoir 56. Beyond the remotely controlled valve 122 there is a connector 124 carrying a pressure transducer 126 to indicate local pressure and joined to a pressure header 127. A plurality of outlets 128 are on the header for any suitable mechanisms to be operated. The pressure header is in parallel with a vent manifold 129 joined to the vent line 123. Both the vent manifold 129 and the pressure header 127 connect through a reversing valve 131 to any sort of downstream connectors 132 and 133.

The manifolds 113 and 114 are at appropriate zones interconnected with reversing valves 141. These are all alike and are in parallel for their respective enclosures 53 so but one is described in detail. Each reversing valve 141 is preferably manually actuated and can be put into either of two positions to connect the manifold 113 to a downstream lead 142 or to connect the manifold 114 with the downstream lead 142. Each downstream lead 142 extends into its own main control valve 143. Each main control valve 143 is remotely controlled so as to be in open position or in closed position. The downstream, submerged enclosure 53 can be isolated by closing the respective main control valve 143, but for normal operations the valves 143 are open, as shown. Pressure on the downstream side thereof is indicated by a pressure transducer 144. The indicated pressure is that of fluid going into a hose reel 146 disposed above the water surface 51 and carrying a predetermined length of hose 147 leading beneath the water surface 51 and to a related one of the submerged enclosures 53. In each hose 147 below the water line there is a discharge valve 148 for emergency drain use, and there is also a shutoff valve 149 which can be utilized in emergency conditions.

Below each of the valves 149 there is a lead 151 (FIGS. 3 and 4) having a branch 152 (FIG. 4) extending into a pressure regulator 153 within the enclosure 53 and preset to a preferred operating value for working liquid; for example, 1500 psi. Connected to the pressure regulator 153 is a small accumulator 154 serving as the source of reference pressure for the pressure regulator 153 which controls the downstream pressure in a line 156. A shock absorber 157 is joined to the line 156 and so to a manifold 158 having connections downstream of the pressure regulator 153 to each of five main valves 161, 162, 163, 164 and 165 involved in the several sequencing circuits within the enclosures 53. Each of the circuits is comparable to the arrangement shown in FIG. 1 which has as an object the combination of components such as 13, 31, 42, 37 and 43 to effect a sequencing arrangement which has no external leakage. The manifold 158 also has a branch connection 167 going through a filter 168 to a hydraulic actuator 169 for a cross-over valve 171.

Joined between undersea wells (not shown) and the surface are a production line 178 and a service line 179. These can be arranged for fluid conduct in either direction when properly set up. The cross-over valve 171 is joined to both the lines 178 and 179 and isolates or interconnects them.

The valves 161 through 165 are substantially identical so that a description of one applies equally to the others. For example, the line 156 extends into an inlet port 181 under control of the valve spool, while a vent line 182, also under control of the valve spool, goes to a vent manifold 183 discharging through multiple check valves 184 and 186 to a point away from the sea.

The pressure lead 151, carrying a shock absorbing accumulator 188, extends to a manifold 189 having branches 191 through 195, inclusive, for each of the valves 161 through 165. The pressure branches 191 through 195 thus transmit in parallel whatever pressure is in the lead 151 to one operating end of each of the valves 161 through 165, inclusive.

The other operating end of each of the valves 161 through 165 is normally urged against the incoming pressure by a spring 197, and each also has its individual one of a number of parallel leads 198 to pressure relief valves 201 through 205, inclusive. Each pressure relief valve has its own individual set mechanism 207 so that its pressure effect can be regulated. Likewise, each relief valve has a check valve 208 in shunt for return flow. The outlet of each of the pressure relief valves 201 through 205, inclusive, is through a related line 209 into a manifold 211 connected by a lead 212 to a special accumulator 213. There is a convenience valve 214 used as an aid in filling, bleeding and testing the system. It is normally open and discharges excessive fluid collected in the accumulator 213 through a spring loaded check valve 216 to the sea.

The special accumulator 213 carries pressure liquid on one side of a transverse flexible diaphragm 217 therein. It also has sea water in a compartment 218 on the other side of the diaphragm 217 because a connecting pipe 219 extends from the interior of the accumulator 213 to the open sea. On one side, the diaphragm 217 is thus subject to the particular sea water pressure at the particular depth or elevation of the pipe 219. Each of the relief valves 201 through 205 is subject on the downstream side to the immediately available submergence pressure at the particular height or elevation of the individual enclosure 53.

At installation, each of the relief valves 201 through 205, inclusive, is set for a distinctly different response or regulated pressure. For example, the relief valve 201 is set for 2000 psi, the relief valve 202 is set for 2500 psi, the relief valve 203 is set for 3000 psi, the relief valve 204 is set for 3500 psi, and the relief valve 205 is set for 4000 psi.

Taking the initially closed valve 161 as an example, equally descriptive of the other, similar valves, the pressure in the lead 151 and the branch 191 can be considered as low and unable to move the valve spool against the force of the spring 197 and the liquid pressure on the other end of the valve spool. The right end liquid pressure is that in the lead 198 and is equal to the pressure caused by the hydrostatic head of the sea water effective at the depth of the connecting pipe 219. Increasingly higher pressure in the lead 151 and the branch 191, as regulated by the manual pressure set point controlling mechanism 99, tends increasingly to urge the valve spool to the right. When that increasing pressure rises enough it overcomes the spring force and the pressure in the lead 198 acting against the right end of the valve spool. That is, as soon as the pressure in the branch 191 is effective to overcome the spring force and the pressure in the lead 198 established by the set point pressure of the pressure relief valve 201, the pressure relief valve 201 opens and discharges fluid through the line 209 and the lead 212 into the left chamber of the special accumulator 213 by flexing the diaphragm 217 therein. The valve 161 is so moved into open position. The valve 161, for example, goes from closed position to open position at an arbitrarily selected set pressure of 2000 psi. Thus the valves of the enclosures 53 can be calibrated on the surface and then lowered beneath the ocean and will be in proper calibration at their selected depths.

By a similar operation, as the pressure is raised further by manipulation of the manual pressure set point controlling mechanism 99, the valve 161 remains open at the rising pressure above 2000 psi, and the valve 162 opens at 2500 psi, and so on. The reverse occurs in that when the manual pressure set point controlling mechanism 99 is changed to reduce the pressure in the lead 151 from the high values to lower values, then the valve 165, having been the last to open as the pressure exceeded 4000 psi, is the first to close as the pressure in the manifold 189 drops below 4000 psi, and so on back to the valve 161, which closes as the pressure in the branch 191 drops below 2000 psi. Thus, while the working line pressure controlled by all of the main valve spools is that set by the pressure regulator 153 and is only about 15000 psi for auxiliary operation, nevertheless the valves 161 through 165, inclusive, are operated in ascending and descending sequences as the pressure in the lead 151 is varied from below 2000 psi to above 4000 psi.

The described operations are utilized to control a number of sub-sea valves in proper or selected sequence. For example, as soon as the pressure in the line 156 achieves the working value of 1500 psi, a corresponding pressure is exerted through the branch connection 167. While the cross-over valve 171 is normally open, yet as the pressure in the branch connection 167 is increased to 1500 psi, that pressure is effective on the hydraulic actuator 169 to close the cross-over valve 171 and thus to isolate the production line 178 from the service line 179.

The hydraulic actuator 169 is readily operated because a drain line 221 therefrom is open to a vent manifold 222 having a connection 223 to a special accumulator 224 like the special accumulator 213 and similarly having a connector 226 to the open sea. There is a convenience valve 227 normally open through a spring closed check valve 228 for use as an aid in filling, bleeding and testing the system. It also serves to discharge excessive fluid collected in the special accumulator 224. In this fashion the pressure in the vent manifold 222 is always kept at a value equivalent to the pressure of the surrounding water as sampled by the connector 226.

In a comparable fashion, when the pressure comes up to about 2000 psi, the valve 161 is actuated to permit flow in a line 231 and through a filter 232 into a pipe 233 leading to the actuator 234 (FIG. 5) of a service safety valve 236 interposed near the end of the service line 179 and effective to move that valve from its previously closed position into open position. A drain line 235 goes from the actuator 234 to the vent manifold 222.

Opening of the valve 161 does more than open the service safety valve 236. Also, the pipe 233 through a branch 237 (FIG. 4) transmits a similar pressure to an actuator 238 having a drain line 239 going to the vent manifold 222 and effective to operate a production safety valve 241. This production sub-sea safety valve is incorporated near the working end of the production line 178. Thus, opening of the valve 161 operates both the production safety valve 241 and the service safety valve 236.

In a similar fashion, when the pressure rises to 2500 psi in the manifold 189, the valve 162 is opened and supplies working fluid at 1500 psi pressure to a line 242 leading into a branch 243 and into a branch 244. The branch 243 extends to a split duct 246 (FIG. 5), one end of which goes to a valve 247 which is normally open and then though a regulator having a variable orifice 248 and a one-way or check valve 249 opening toward a line 250 into an actuator 251 for a service master valve 252. When the valve 162 is opened and pressure is available through the line 242, branch 243 and split duct 246, virtually no flow occurs through the variable orifice 248, since the check valve 249 opens fully for principal flow into the actuator 251 so that the service master valve 252 is opened quickly and in series with the service safety valve 236. Conversely, when pressure in the line 242, branch 243 and split duct 246 drops when the valve 162 is reversed, the back flow shuts the check valve 249, and the actuator 251 closes the service master valve 252 slowly because of the restricted orifice 248.

When pressure in the split duct 246 is high, another duct 253 branching therefrom feeds through a normally open valve 254 and through a series connected and normally open valve 256. Flow is then through a regulator having a variably restricted orifice 257 and a downstream closing check valve 258 to an actuator 259 for a valve 261. This valve 261 is in series in the service line 179 and is a service wing valve. When the pressure in the duct 253 is relatively high, the valve 261 is opened slowly; but when the pressure in the duct 253 drops because the valve 162 is reversed, the check valve 258 opens and allows the valve 261 to close quickly. When the valve 261, the service master valve 252 and the service safety valve 236 are all open, there is free flow through the service line 179.

From the point (FIG. 4) at which the branch 243 branches from the line 242, the branch 244 continues to a flow control valve 266 containing a downstream opening check valve 267 and a variably settable flow restrictor 268. Flow through the flow control valve 266 is unrestricted in the downstream direction and goes into an actuator 269 for a production main valve 271 in the production line 178. The production main valve 271 is thus quickly opened by the valve 162. The return from the actuator 269, as it is from all actuators, is to the vent manifold 222, in this case through a line 272. In this way the production main valve 271 is rapidly opened when there is high pressure in the branch 244, since the check valve 267 opens for that purpose. When the valve 162 is reversed and the pressure in the branch 244 drops to a low value, the check valve 267 closes; and there is then a slow closure of the production main valve 271 because of the restrictor 268.

The branch 244 continues to a flow control valve 273 including a downstream closing check valve 274 and a variable restrictor 276 in turn carrying flow to an actuator 277 of a production wing valve 278 in the production line 178. Thus, when pressure increases in the branch 192 above the 2500 psi value and the valve 162 opens, the check valve 274 closes or remains closed; and there is a slow flow through the restrictor 276 so the actuator 277 slowly opens the production wing valve 278. Under reverse conditions, when the pressure in the branch 192 drops below the value of 2500 psi, the valve 162 reverses and the check valve 274 opens abruptly and the production wing valve 278 is closed quickly.

When the pressure is lifted to 3000 psi in the manifold 189 and the branch 193 and the valve 163 is then shifted, the actuating fluid at 1500 psi pressure in the manifold 158 flows through the valve 163. The outlet line 282 from the valve 163 extends to a branch 284 (FIG. 5) going to an actuator 286 of the spring returned valve 247. The effect is to shift the valve 247 to a cutoff position and a drain position so that the actuator 251 is connected through the line 250 and through the variable orifice 248 to the vent manifold 183, the restriction allowing a slow closure of the service master valve 252.

A branch 288 from the outlet line 282 is joined to an actuator 289 for the spring returned valve 254 so that the connections of that valve are crossed. Thus, actuation of the valve 163 not only shuts off the service master valve 252 with a slow closure but likewise connects the actuator 259 to drain through the open check valve 258 and through a duct 290 joined to the vent manifold 183 so that the valve 261 closes quickly.

As the pressure in the lead 151 continues to increase and is reflected in the branch 194, the valve 164 is shifted at 3500 psi and then connects actuating fluid from the manifold 158 to a line 291, which is branched. One branch, a line 292, extends to two actuators. One is an actuator 294 controlling a valve 295, an annulus master valve, disposed in a conduit 296 joined to the production line 178 and extending to the annulus, not shown. Discharge from the actuator 294 is through a line 297 going to the vent manifold 222. A line 298 from the line 292 goes to a spring returned bridle actuator 299 operating a bridle valve 301.

Figure 5:
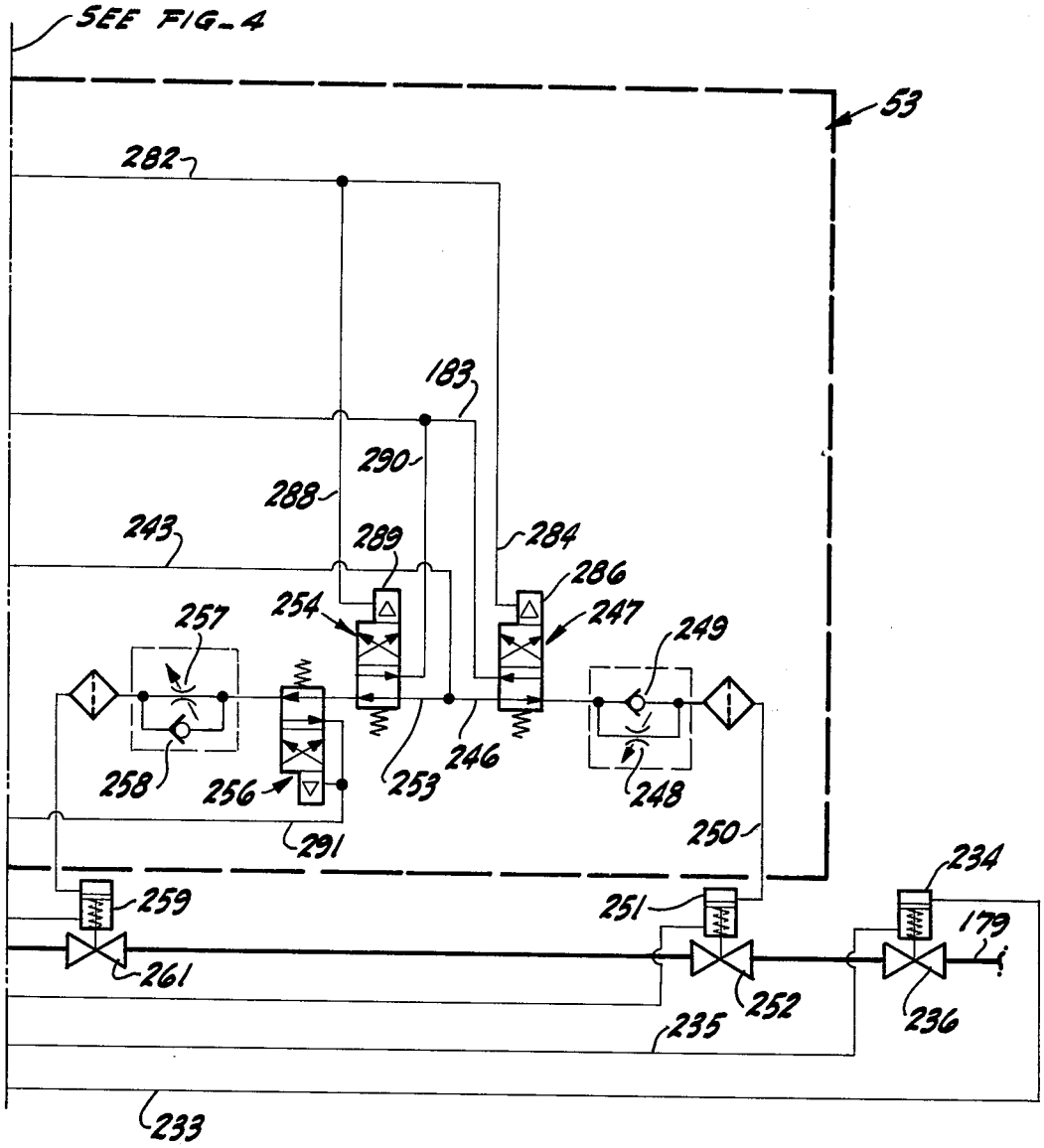

From the point in the line 291 from which the line 292 branches, the line 291 continues to the actuator for the series valve 256 (FIG. 5). This valve is in series with the valve 254 so that when the series valve 256 shifts under control of the valve 164, the connections are crossed and the actuator 259 instead of being connected to the duct 253 is instead connected to the line 291. The effect then is that the pressure from the line 291 is slowly metered through the variably restricted orifice 257 so that the actuator 259 again opens the valve 261 slowly.

Additionally, rising pressure in the lead 151 is conducted to the valve 165 and overcomes the resistance pressure of 4000 psi imposed thereon by the pressure relief valve 205. The spool of the valve 165 then shifts so that the service line 156 and the manifold 158 are directly connected through a filter to a line 302 going to an actuator 303 joined to a spring returned buoy valve 304 and so releasing a buoy (not shown).

By running the pressure in the lead 151 from a low value up through the successive pressures of 2000, 2500, 3000, 3500 and 4000 psi, the various operating valves can be successively opened and closed either slowly or quickly, as described.

There has thus been provided an arrangement in which by a simple or a redundant surface control a number of subterranean enclosures can be accurately operated despite variations in the elevations or depths thereof below the ocean surface. There is automatic compensation for the actual depth provided by the various special accumulators such as 213 and 224 open to the sea by the connecting pipe 219 and the connector 226, and there is little or no hydraulic discharge to the surroundings.

We claim:

1. A subaqueous sequence valve mechanism comprising a main valve adapted to be disposed in the water below the surface thereof, a first expansible chamber hydraulic actuator secured to and effective to operate said main valve, means above said surface for supplying hydraulic fluid under pressure, means connecting said supplying means to said first expansible chamber, a second expansible chamber secured to and opposing operation of said main valve by said first expansible chamber actuator, a hydraulic fluid accumulator having a movable barrier, means for hydraulically connecting said second expansible chamber and said hydraulic fluid accumulator on one side of said movable barrier, means for connecting said hydraulic fluid accumulator on the other side of said movable barrier to said water, a spring, means disposing said spring to resist the contraction of said second expansible chamber, a relief valve, means for connecting the upstream side of said relief valve and said second expansible chamber, and means for connecting the downstream side of said relief valve and said hydraulic fluid accumulator on said one side of said barrier.

2. A device as in claim 1 including a throttle valve interposed in said means for connecting the upstream side of said relief valve and said second expansible chamber.

3. A device as in claim 1 including a shunt hydraulic line connected around said relief valve.

4. A device as in claim 3 including a check valve in said shunt hydraulic line, said check valve closing to block flow toward said accumulator.

5. A device as in claim 1 including a spring loaded check valve in said means for connecting the downstream side of said relief valve and said accumulator, said spring loaded check valve opening into said water.

* * * * *